US006595458B1

(12) United States Patent
Biagiotti

(10) Patent No.: US 6,595,458 B1
(45) Date of Patent: Jul. 22, 2003

(54) METHOD AND DEVICE FOR THE PRODUCTION OF ROLLS OF WEB MATERIAL WITHOUT A WINDING CORE

(75) Inventor: Guglielmo Biagiotti, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 09/959,627

(22) PCT Filed: May 9, 2000

(86) PCT No.: PCT/IT00/00181

§ 371 (c)(1),
(2), (4) Date: Nov. 1, 2001

(87) PCT Pub. No.: WO00/68129

PCT Pub. Date: Nov. 16, 2000

(30) Foreign Application Priority Data

May 11, 1999 (IT) ..... FI99A0112

(51) Int. Cl.[7] ..... B65H 18/16

(52) U.S. Cl. ..... 242/532.2; 242/533.7; 242/542; 242/581

(58) Field of Search ..... 242/532.2, 521, 242/533.7, 542, 542.1, 542.2, 581

(56) References Cited

U.S. PATENT DOCUMENTS

| | | | | |
|---|---|---|---|---|
| 3,869,095 A | | 3/1975 | Diltz | |
| 4,177,410 A | | 12/1979 | Dowd | |
| 4,327,877 A | * | 5/1982 | Perini | 242/521 |
| 4,606,381 A | * | 8/1986 | Suwa et al. | 139/1 R |
| 4,840,322 A | * | 6/1989 | Masuda et al. | 242/532.4 |
| 5,137,225 A | * | 8/1992 | Biagiotti | 242/521 |
| 5,368,252 A | * | 11/1994 | Biagiotti | 242/521 |
| 5,421,536 A | | 6/1995 | Hertel et al. | |
| 5,538,199 A | * | 7/1996 | Biagiotti | 242/541.2 |
| 5,542,622 A | * | 8/1996 | Biagiotti | 242/521 |
| 5,639,046 A | * | 6/1997 | Biagiotti | 242/541.2 |
| 5,690,296 A | * | 11/1997 | Biagiotti | 242/521 |
| 5,797,559 A | * | 8/1998 | Coffey | 242/527.6 |
| 5,853,140 A | * | 12/1998 | Biagiotti | 242/534 |
| 5,979,818 A | * | 11/1999 | Perini et al. | 242/521 |
| 6,270,034 B1 | * | 8/2001 | Kury et al. | 242/533.4 |

FOREIGN PATENT DOCUMENTS

| | | |
|---|---|---|
| EP | 0 618 159 A2 | 10/1994 |
| IT | 1104233 | 10/1985 |
| IT | 1201390 | 1/1989 |
| WO | WO 94/21545 | 9/1994 |

* cited by examiner

*Primary Examiner*—Kathy Matecki
*Assistant Examiner*—Sang Kim
(74) *Attorney, Agent, or Firm*—Breiner & Breiner, L.L.C.

(57) ABSTRACT

A surface rewinding machine for the production of rolls of wound web material is described. The machine comprises: a winding cradle (1, 3, 5) for winding the web material and sequentially forming rolls (R) of wound web material; an insertion device (25) for inserting sequentially, into said winding cradle, winding spindles (M1; M) on which the rolls are formed; an insertion path for the spindles inside the winding cradle. A suction system (51) which follows the spindles along at least one portion of the insertion path so as to produce a vacuum inside the spindles is also envisaged.

32 Claims, 7 Drawing Sheets

IV
IV
A-A
C-C
N
N
M
M1
L
1
1A
3
5
7
9
11
13
15
17
19
21
23
25
27
31
32
34
36
36A
36B
51
59
61
63
67
69
71

METHOD AND DEVICE FOR THE PRODUCTION OF ROLLS OF WEB MATERIAL WITHOUT A WINDING CORE

TECHNICAL FIELD

The present invention relates to a rewinding machine for the production of rolls of web material, for example rolls of so-called tissue paper, so as to obtain small rolls of toilet paper, all-purpose drying paper and the like.

The present invention also relates to a method for the production of rolls without a central winding core.

BACKGROUND ART

In order to produce rolls or "logs" of web material, so-called rewinding machines are commonly used, in which machines a predetermined length of web material is wound onto a tubular winding core normally made of cardboard. These rolls or logs are then cut into a plurality of smaller-size rolls intended for sale. A tubular winding core section remains inside each small roll.

The winding machines of this type are divided into two categories depending on the manner in which the winding movement is provided. In a first type of rewinding machine, known as a central spindle rewinding machine, a spindle supported on support elements between a pair of side walls receives a tubular winding core on which the roll or log is formed by means of rotation of the spindle which, for this purpose, is associated with drive means. The winding movement is therefore provided centrally by the spindle.

In a second type of rewinding machine, known as a surface rewinding machine, the rotational movement of the tubular core on which the roll or log is formed is provided by peripheral members in the form of rollers or rotating cylinders and/or belts with which the roll or log is kept in contact during formation. An example of a surface rewinding machine is described in WO-A-9421545.

In both cases the end product contains a tubular core made of material different from that forming the roll.

In an attempt to obtain rolls provided with an axial hole, but without a winding core made of material different from that forming the roll, various systems have been studied. Italian Patent No. 1201390 describes a surface rewinding machine in which the cardboard tubular winding core is replaced by a recyclable winding spindle. A system for extraction of the spindle from the finished roll and for recycling said spindle towards the zone for insertion into the rewinding machine is provided downstream of the winding zone. A rewinding machine based on the same, concept is described in U.S. Pat. No. 5,421,536.

One of the difficulties of these machines and the associated winding methods relates to the first winding phase when the leading edge of the web material must be made to adhere to the spindle so as to start formation of the turns.

U.S. Pat. No. 3,869,095 describes a system in which a winding spindle receives, mounted on it, a tubular core on which a roll of wound web material is subsequently formed. The roll with its winding core is then extracted from the spindle and the tubular core remains inside the end product. In this known machine both the spindle and the tubular core are provided with holes so as to be able to suck the web material and wind it around the winding core. The spindle is kept constantly connected to suction means which follow the movement of the spindle during formation of the roll which is formed on a cradle defined by two parallel-axis rollers.

Moreover, the spindle is supported by support slides which travel in lateral sliding guides and is gradually raised during winding.

EP-A-0 618 159 describes a spindle-type rewinding machine where the rolls of web material are formed around a motor-driven spindle which is subsequently extracted from the roll. During extraction, a stabilizing fluid is introduced through holes formed in the spindle so as to ensure the rigidity of the walls forming the axial hole of the roll. This publication also describes, in general terms, how the holes in the spindle may be used to suck the leading edge of web material. However, no system for applying the vacuum to the spindle is described.

Italian Patent Application No. 9652A/78, dated Dec. 1, 1978, describes a surface rewinding machine in which cardboard tubular cores which remain inside the finished roll are used for winding. A system for providing holes in the cardboard forming the tubular cores is also described. A sucking action is produced through these holes so as to cause the leading edge of the web material to adhere to the tubular core and allow winding to be started. The vacuum inside the tubular core is produced by means of one or two suction ducts which are located in a fixed position, This device, therefore, is able to function only using particularly slow winding methods in which the axis of the tubular core is not displaced or performs minimum movements until one or more winding turns have been completed. A system of blowing nozzles is also required in order to start winding of the free leading edge around the tubular core.

OBJECTS AND SUMMARY OF THE INVENTION

One object of the present invention is to provide a method and a surface winding device which allow the production of rolls or logs without a tubular core, in which the initial step for causing the free leading edge of web material to adhere to the winding spindle is efficient, fast and reliable and is suitable for high production speeds.

A further object of the present invention is to provide a method and a device of the abovementioned type, in which the step involving extraction of the spindle from the finished roll or log is easy and is not affected by the procedures used to start winding.

These and further objects and advantages, which will become clear to persons skilled in the art from a reading of the text below, are obtained by means of a surface rewinding machine of the type comprising a winding cradle for sequentially forming rolls of web material, an insertion device for inserting the winding spindles into the winding cradle and an insertion path for introducing the winding spindles into the cradle. According to the invention, a rewinding machine of this type is provided with a suction system cooperating with the spindles along at least one portion of the insertion path so as to produce a vacuum inside the spindles which have a wall which is permeable to air and typically provided with a series of holes which could also have microscopic dimensions. The suction system follows the movement of the spindles over at least part of the insertion path. This enables high production speeds to be achieved.

With this arrangement, a vacuum is produced inside each spindle during the insertion movement of the spindle into the winding cradle. During insertion, the leading edge of the web material comes into contact with the external surface of the spindle and adheres to the latter owing to the effect of the suction through the holes formed in the spindle wall. The holes may be distributed in various ways. One possibility consists in a random distribution. Alternatively, the holes may be distributed in one or more lines which extend in a helical manner along the whole spindle. Or else the holes may be distributed in annular lines arranged at suitable intervals along the axial extension. According to a further alternative, the holes are distributed along one or more aligned arrangements parallel to the spindle axis.

In a practical embodiment of the invention, the suction system may comprise a nozzle, or preferably two nozzles, one for each end of the spindle, movable along an operating path along which the nozzle or nozzles are connected pneumatically to the inside of the spindle while the latter is inserted into the winding cradle, moving along the insertion path.

The movement along the operating path and the form of the latter depend on the configuration of the rewinding machine. Generally, the present invention may be applied to any surface rewinding machine, independently of the configuration of the winding cradle. The latter may preferably consist, for example, of three winding rollers, as described in WO-A-9421545. However, the winding cradle may also be defined by different winding members, for example systems of belts, combinations of belts or rollers or the like, as known to persons skilled in the art.

Although, in principle, it is possible to use a single suction nozzle pneumatically connected to the spindle, at one end of the latter, in order to obtain a uniform vacuum and therefore a uniform suction effect along the axial extension of the spindle, it is preferable to use two nozzles, one for each end of the spindle.

When the winding cradle comprises at least one first winding roller around which the web material to be wound is fed, it is possible to envisage that the operating path of the nozzle or nozzles is substantially circular, or more precisely in the form of an arc of a circle, with the center approximately on the axis of rotation of the first winding roller. According to the preferred embodiment of the invention, it is envisaged that the first winding roller has, extending around it, a rolling surface (in a manner known per se, for example, from WO-A-9421545) which is substantially fixed with respect to the axis of rotation of the first winding roller. The operating path of the suction nozzle or nozzles extends along the channel defined between the first winding roller and the rolling surface, while the spindle rolls on the rolling surface, remaining in contact with the latter and with the surface of the first winding roller or, more precisely, with the web material conveyed around the latter.

The suction nozzle or nozzles, according to a possible embodiment of the invention, are mounted on a unit rotating about the axis of the first winding roller. It is also envisaged providing a device which controls the movement of the unit about the axis of rotation of the roller in synchronism with the movement of the insertion device which sequentially inserts the spindles along the insertion path.

Essentially, in order to avoid problems of collision of the nozzles with other machine components, the movement of the nozzle is an alternating oscillating movement instead of a continuous rotational movement. During forwards travel; the nozzles follow the movement of the spindle being inserted. Once they have completed their function, the nozzles return into the initial position with a movement in the opposite direction.

The oscillating movement of the unit supporting the nozzle or nozzles about the axis of the first winding roller may be obtained, for example, by means of a system comprising a motor and a pinion and crown-wheel transmission system. However, according to a particularly advantageous embodiment of the invention, the rotating unit may support a small shaft which has an axis perpendicular to the axis of rotation of the first winding roller and on which a wheel is mounted in an idle manner. Said wheel is made to roll over a surface not rotating with respect to the axis of rotation of the first winding roller and over an annular surface of the first winding roller, perpendicular to its axis. In this way, as will be clarified more fully below, the unit supporting the nozzle or nozzles moves at a speed equal to the speed of movement of the individual spindles along the insertion path. This solution is particularly advantageous because it is mechanically simple and can be easily synchronized with the spindle movement, without the need for special measures.

Essentially, suction may be maintained until winding of the first turn of web material onto the spindle has been completed.

Further advantageous features of the rewinding machine according to the invention are indicated in the accompanying dependent claims.

The winding method according to the invention envisages using suction holes on the spindle and causing a leading portion of the web material to adhere to said spindle by means of suction through said holes obtained by producing a vacuum inside the spindle. Essentially, winding is of the surface type and the suction is maintained inside the spindle along a section of the insertion path which it follows within the winding means.

In one mode of implementation of the method according to the invention, the winding spindle is introduced into a winding cradle along an insertion path. A vacuum is temporarily produced along this path, inside the winding spindle. The spindle may perform a rolling movement along the insertion path. The vacuum inside the spindle may be obtained by arranging next to one end thereof (or preferably both ends) a suction nozzle which follows the movement of the spindle over at least a portion of the insertion path.

Further advantageous features and modes of implementation of the method according to the invention are described in the accompanying claims.

BRIEF DESCRIPTION OF THE DRAWINGS

The invention will be understood more clearly from a reading of the detailed description which follows and with reference to the accompanying drawings which show a practical embodiment of the invention. More particularly, in the drawings.

DETAILED DESCRIPTION OF THE PREFERRED EMBODIMENT OF THE INVENTION

Figure 1:
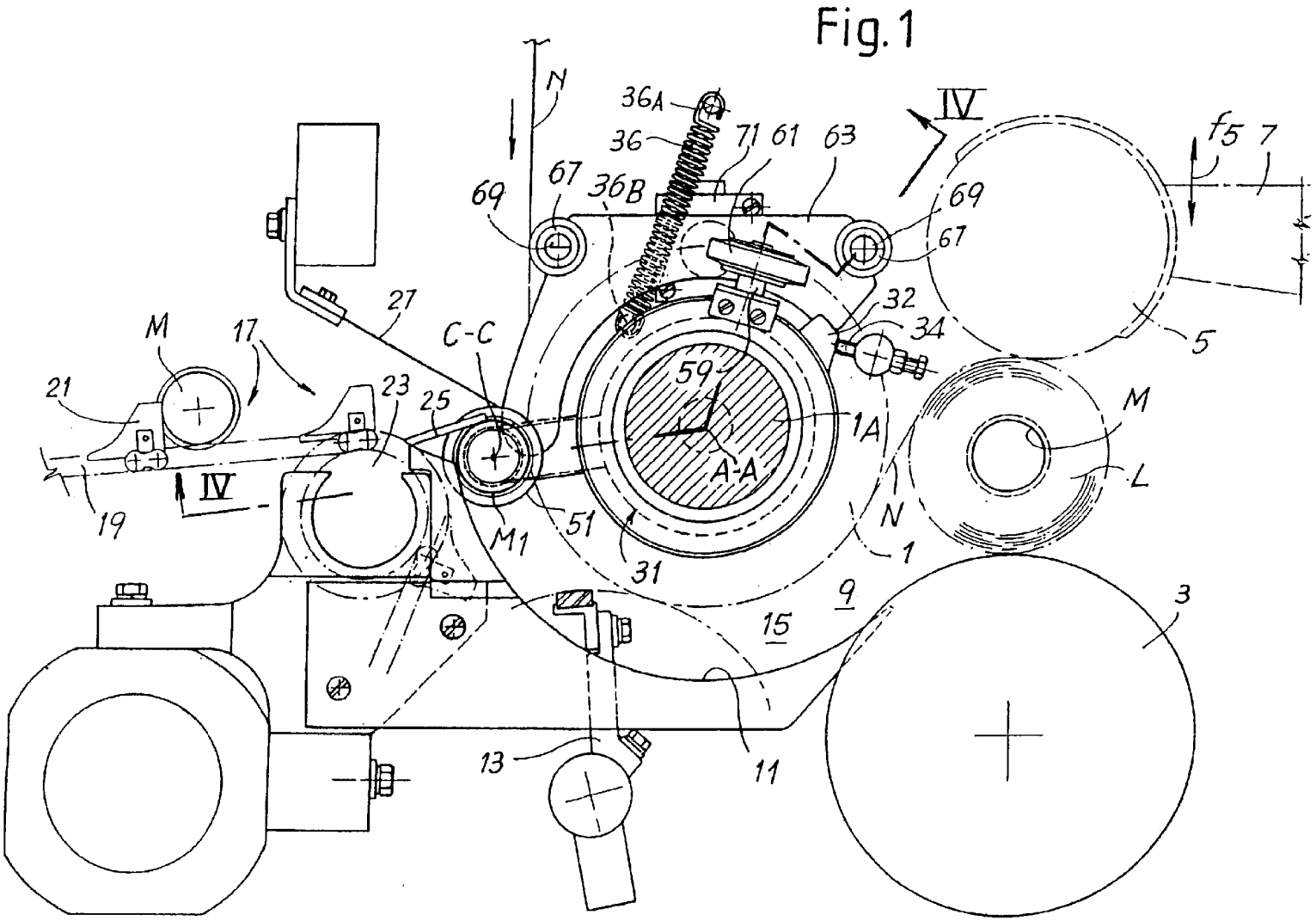
FIG. 1 shows a cross-section along the line 1—1 according to FIG. 4, in which the suction device and the winding cradle can be seen.

The invention is illustrated below with reference to application to a surface rewinding machine of the type described in WO-A-9421545. Further details regarding the machine and the winding method may be found in said international publication. Those features necessary for understanding the present invention will be described below.

The rewinding machine comprises a winding cradle formed by three winding rollers indicated by 1, 3 and 5. The third winding roller 5 is mounted on an oscillating arm 7 which allows its movement in the direction of the arrow f5 so as to allow an increase in the diameter of the roll or log L being formed. As is known per se, the first and the second winding roller 1, 3 form a nip 9 through which the winding spindle passes in the manner described below.

The nip 9 has, arranged upstream of it, a curved rolling surface 11 defined by a comb-like structure through which a mechanism for interrupting or cutting the web material, denoted by 13, passes. The curved rolling surface 11, which has a substantially cylindrical extension with an axis more or less coinciding with the axis of rotation A—A of the first winding roller 1, defines a channel 15 along which the path for insertion of the winding spindles extends.

17 denotes generally an insertion device which has the function of inserting the winding spindles M along the path for insertion into the winding cradle 1, 3 and 5. In this embodiment, the insertion device has a conveyor 19 comprising one or more flexible members in the form of a chain or the like which are driven around a driving wheel 23 opposite which there is a pusher 25 rotating about an axis coinciding with the axis of the driving wheel 23. Above the pusher 25 there is a resilient sheet 27 which has the function of keeping the spindle M in a position ready for insertion.

The mechanism described hitherto corresponds to that already described in greater detail in WO-A-9421545, to the contents of which reference may be made for further details. The difference consists in the fact that extractable and recyclable winding spindles M, which for example are made of plastic, replace the (usually cardboard) tubular cores conventionally used in this type of machine and intended to remain inside the end product.

Figure 4:
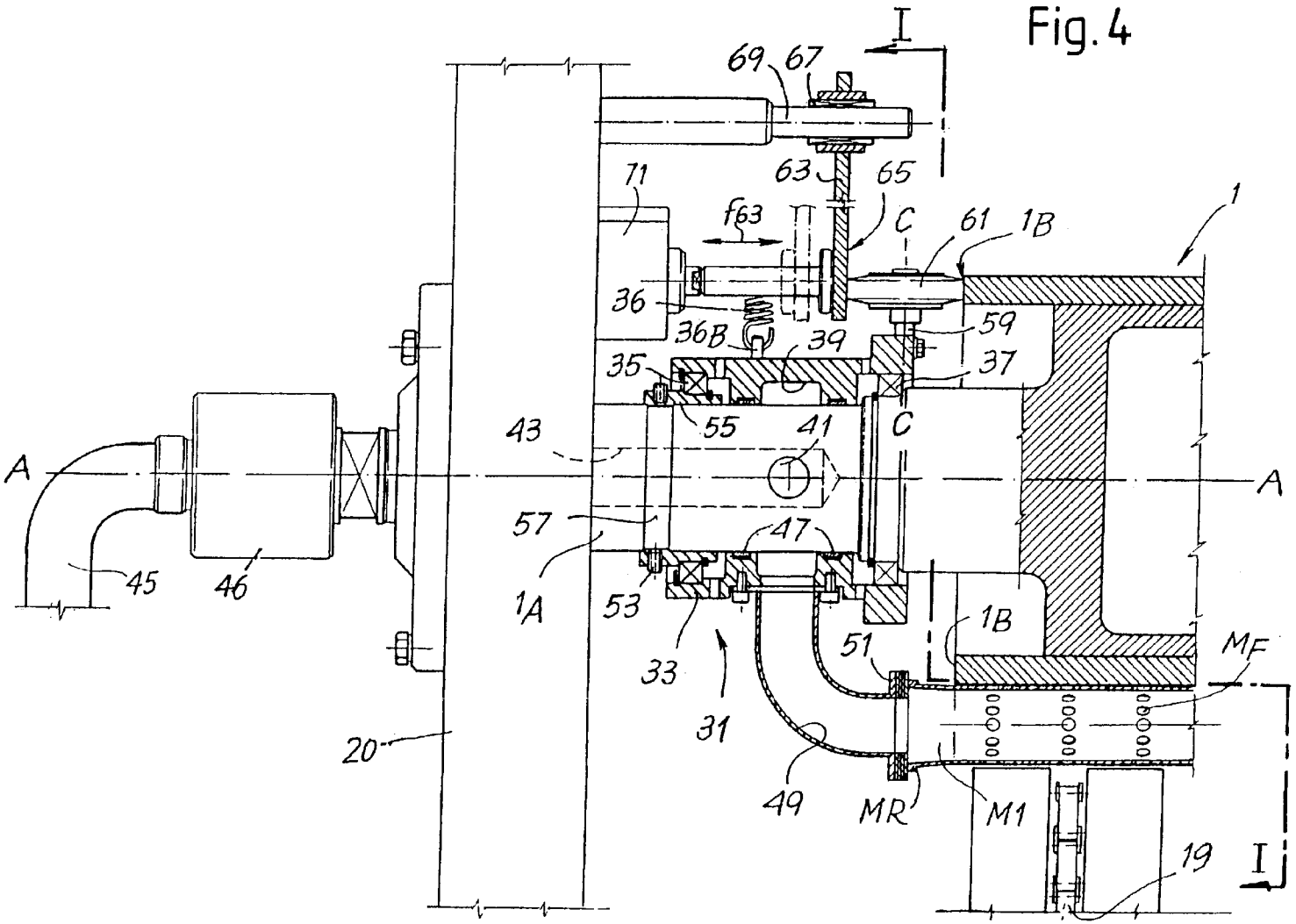
FIG. 4 shows a cross-section along the line IV—IV according to FIG. 1.

As can be seen in particular in FIG. 4, a rotating unit 31 is supported on the shaft 1A of the first winding roller 1 (mounted on the sides 20 of the machine). Essentially two symmetrical units 31 are envisaged, being mounted on the two ends of the shaft 1A of the first winding roller 1. Only one of these units is illustrated in FIG. 4 and will be described below.

The unit 31 comprises a sleeve 33 supported on the shaft 1A of the winding roller 1 by means of bearings 35, 37. The sleeve 33 has an annular passage 39 defining a suction header pneumatically connected to radial holes 41 in the shaft 1A. Said holes are in turn connected to an axial hole 43 connected to a suction pipe 45 situated outside the side wall 20, by means of a rotating joint 46. The annular passage 39 defines a suction volume delimited by seals 47 in frictional contact with the cylindrical surface of the shaft 1A. The annular passage 39 is pneumatically connected to a duct 49 terminating in a suction nozzle 51.

A suction path is thus defined through the nozzle 51, the duct 49, the annular passage 39, the radial holes 41, the axial hole 43, the rotating joint 46 and the pipe 45.

The sleeve 33 may be adjusted in an axial direction on the shaft 1A by means of tightening grub-screws 53 which lock a ring 55 (on which the bearing 35 is fixed) opposite an annular groove 57 on the shaft 1A. The annular groove 57 has dimensions in the axial direction such as to allow adjustment in the position of the sleeve 33. The adjustment is necessary for the purposes which will be described below.

The sleeve 33 has a tooth 32 (see FIG. 1) which cooperates with a fixed but adjustable contact shoulder 34 mounted on the side wall of the machine. A resilient element 36, consisting of a helical extension spring attached at 36A to the fixed structure and at 36B to the sleeve 33, biases the sleeve 33 and therefore the entire unit 31 so as to assume the position shown in FIG. 1, where the tooth 32 rests against the fixed contact shoulder 34.

The sleeve 33 is integral with a shaft 59 on which a wheel 61 is idly mounted. The position of the shaft 59 and the diameter of the wheel 61 are such that the latter makes contact with an annular surface 1B of the roller 1, perpendicular to the axis of the latter. In a position diametrically opposite to the annular surface 1B, with respect to the wheel 61, there is a plate 63 defining a surface 65 not rotating with respect to the axis A—A of the winding roller 1. The plate 63 is supported by sliding bushes 67 sliding on guides 69 mounted on the side wall 20 of the machine. The plate 63 may be displaced in accordance with the arrow f63 in a direction parallel to the axis A—A of the winding roller 1 so as to be moved towards or away from the wheel 61. The translatory movement in the direction of the arrow f63 is provided by a cylinder/piston actuator 71 mounted on the side wall 20. In FIG. 4 the plate 63 is shown in solid lines in its position closest to the winding roller 1, where it makes contact with the wheel 61, while a position of the plate 63 where it does not touch the wheel 61 is shown in broken lines.

When the wheel 61 is in contact with the annular surface 1B and the surface 65 of the plate 63, it rolls on these two surfaces moving over a circumference having a center lying on the axis A—A of the winding roller 1. The axis C—C of the wheel 61 during this movement has an angular speed about the axis A—A equal to half the angular speed of the winding roller 1. The advancing movement of the wheel 61 along the circular path causes a corresponding rotation of the entire unit 31 about the axis A—A of the winding roller 1. During this movement, the helical spring 36 is tensioned.

When, on the other hand, the plate 63 is retracted and does not touch the wheel 61, the latter rotates about its axis, but does not advance, and the unit 31 remains in the position shown in FIG. 1 owing to the action of the spring 36.

The operation of the machine described hitherto is as follows. In the condition shown in FIG. 1, the rewinding machine has nearly completed winding of a roll or log L inside the winding cradle. The finished log has already been partially moved away from the first winding roller 1 and is in contact with the winding rollers 3 and 5. A new winding spindle M1 has been brought by the insertion device 17 into an insertion position where it is retained by the resilient sheet 27. The unit 31 is located in an angular position defined by the tooth 32 and the fixed contact shoulder 34. The device 13 for cutting or interrupting the web material N is located in the position ready to perform interruption of the web material. In a synchronized manner the pusher 25 pushes the new spindle M1 inside the channel 15 defining the insertion path, forcing said spindle between the curved surface 11 and the cylindrical surface of the first winding roller 1, the web material N remaining between the new spindle M1 and the surface of the winding roller 1.

The spindle M1 starts to rotate along the curved surface 11 owing to rotation of the winding roller 1. During this movement, the axis of the spindle M1 advances along a circular path with a speed equal to half the peripheral speed of the winding roller 1.

At the same time as the thrust exerted by the pusher 25 on the new spindle M1, the approach movement of the plate 63 towards the wheel 61 is also caused by the cylinder/piston actuator 71, said plate having remained until now in the retracted position shown in dot-dash lines in FIG. 4. Consequently, as the new spindle M1 starts to advance along the insertion path defined by the channel 15, the nozzles 51 mounted on the two units 31 at the ends of the first winding roller 1 start to follow the same path followed by the spindle M1. As stated above, the speed of movement of the axis of the spindle M1 along the insertion path is equal to the speed of movement of the nozzle 51. Consequently, each nozzle 51 remains facing the respective end of the spindle M1, as can be seen in FIG. 4.

There may be slight contact or also a very small distance between the front surface of the nozzle 51 and the side of the spindle M1 so that the suction through the duct 49 creates a vacuum inside the spindle M1. This vacuum causes a sucking action through the holes MF formed in the cylindrical casing of the spindle M1. This sucking action causes the web material N to adhere onto the external surface of said spindle. Consequently, when the cutting or interruption device 13 has caused cutting or tearing of the web material in a manner known per se (see WO-A-9421545), the free edge which is produced by interruption of the web material starts to be wound onto the spindle.

Figure 2:
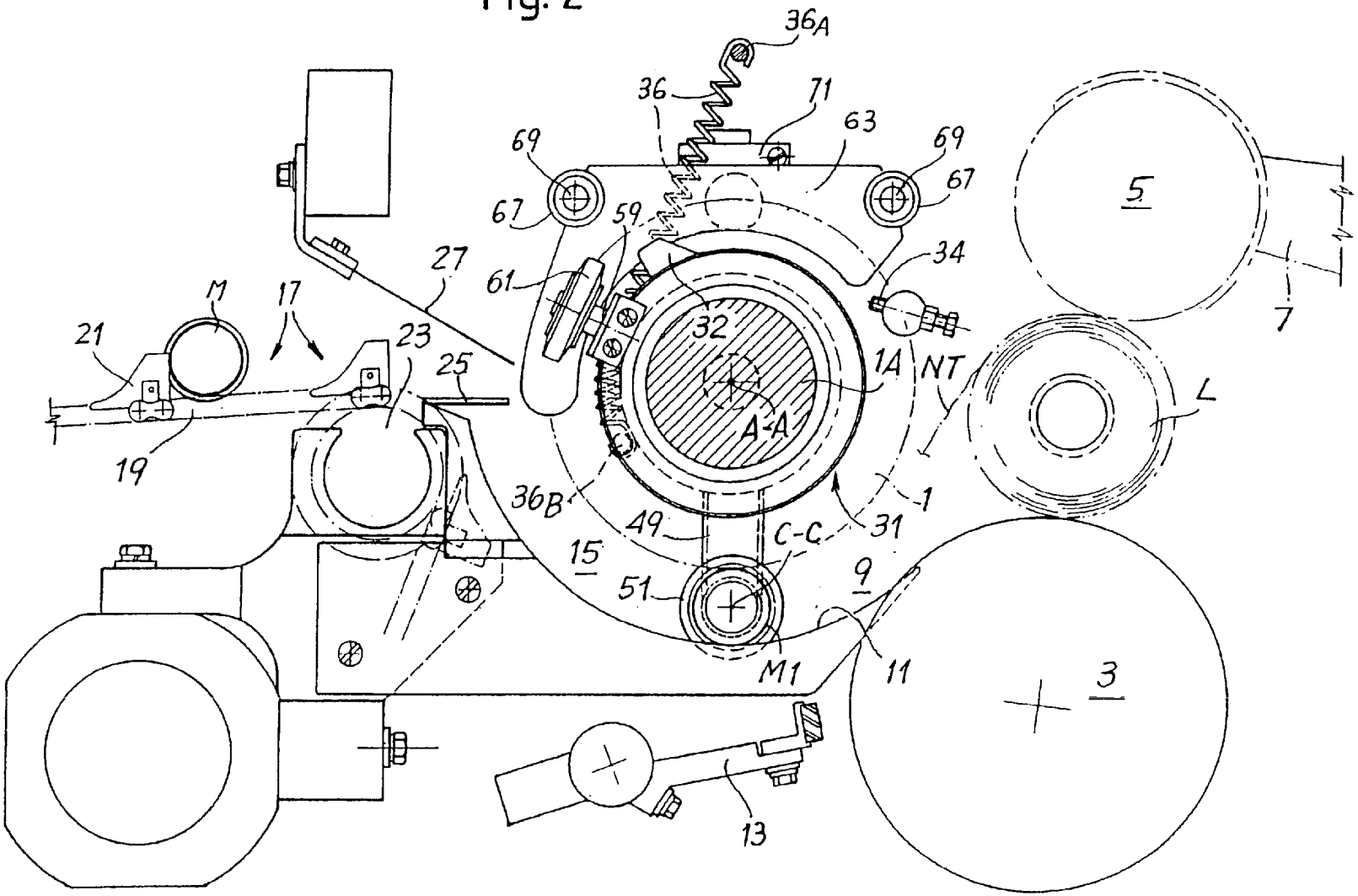
FIGS. 2 and 3 show cross-sections similar to that of FIG. 1 during two successive phases of the winding cycle.

The sucking action is maintained over a portion of the section of the path for insertion of the spindle between the positions shown in FIGS. 1 and 2. The position shown in FIG. 2 corresponds to the situation where the web material N has been interrupted, producing a trailing edge NT which will be wound up onto the log L to be unloaded, and a leading edge which is being wound onto the new spindle M1. The angular position assumed by the suction nozzles 51 represents the end position beyond which suction inside the spindle M1 is no longer required since at least one turn of web material has already been formed around it. Therefore, the cylinder/piston actuator 71 may cause retraction of the plate 63 which consequently no longer makes contact with the wheel 61. The latter is thus no longer forced to roll between the surface 65 and the surface 1B of the winding roller 1, with the result that the spring 36 recalls the unit 31 into the original position, bringing it into the condition shown in FIG. 3.

Figure 3:
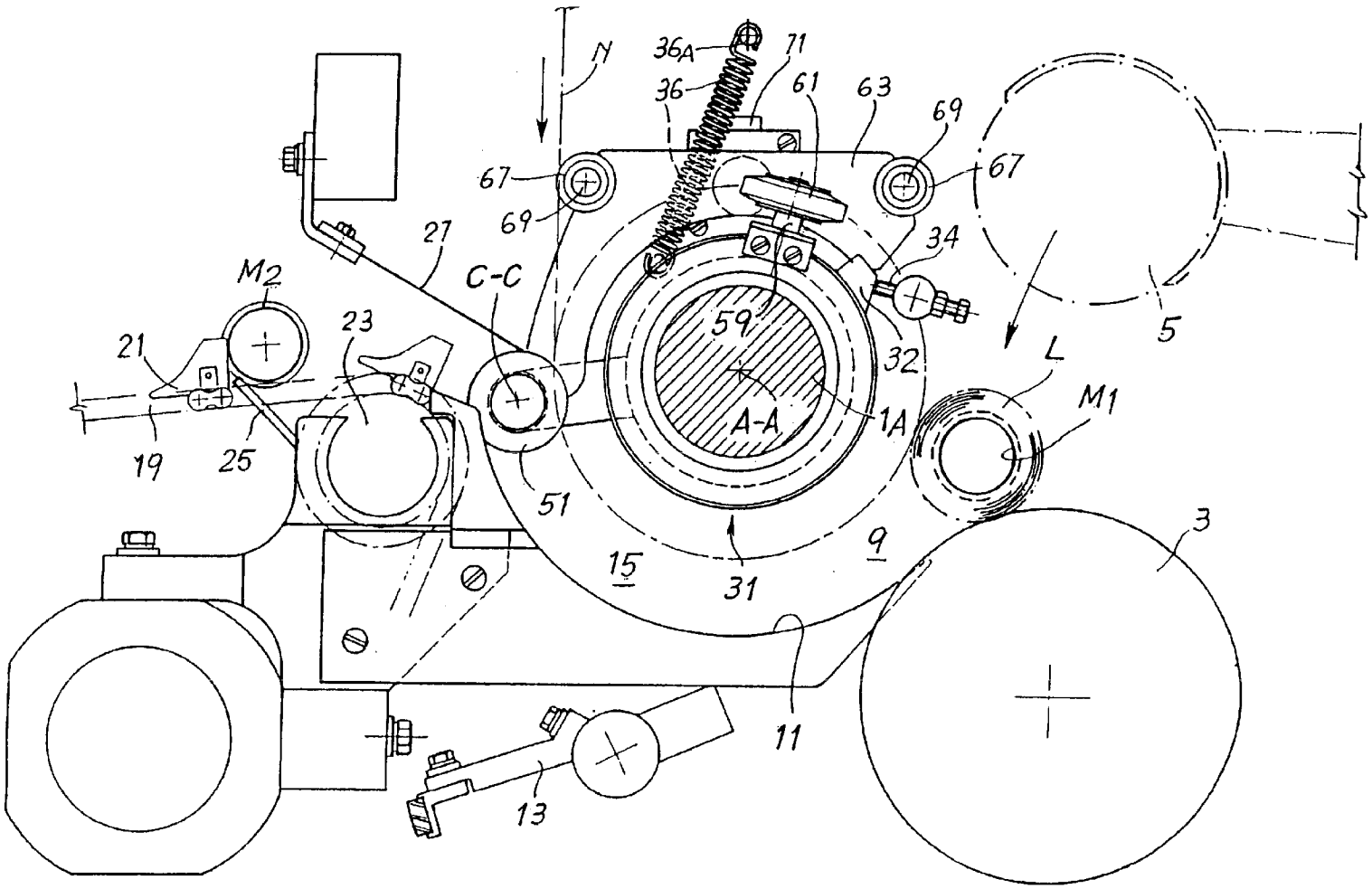

A new spindle M2 is then positioned for the next winding cycle. In FIG. 3 the spindle M1 is located at the exit of the nip 9 and is about to come into contact with the third winding roller 5 which is lowered after allowing expulsion of the previous log L.

In order to dampen the impact between the tooth 32 and the contact shoulder 34 during the return movement into the position shown in FIG. 3, the tooth 32 may be lined with elastomer material.

Since the wheel 61 is subject to wear, in order to prevent it from no longer making contact with the annular surface 1B, the possibility of axially adjusting the position of the sleeve 33 is envisaged (described above). Alternatively, it is envisaged that the shaft 59 supporting the wheel 61 may be mounted on the unit 31 in an oscillating manner and that any wear of the wheel may be offset by greater oscillation of the shaft 59 towards the surface 1B under the thrust of the plate 63.

The spindles M may be made as one piece and optionally divided in the center by a diaphragm. Alternatively, each spindle may be made as two portions, each of which having a length equal to half the complete spindle.

The unit 31 may be moved about the axis A—A of the winding roller 1 also using a different mechanism. For example, the sleeve 33 may be provided with a crown wheel meshing with a pinion keyed onto an output shaft of a motor mounted on the side wall 20. The motor may rotate in both directions so as to cause an oscillating movement about the axis A—A or may rotate always in the same direction so as to provide the unit 31 with a continuous rotary movement. However, this second solution involves design difficulties owing to the risk of the nozzles 51 colliding, during a complete rotation, with other mechanical components.

Figure 5:
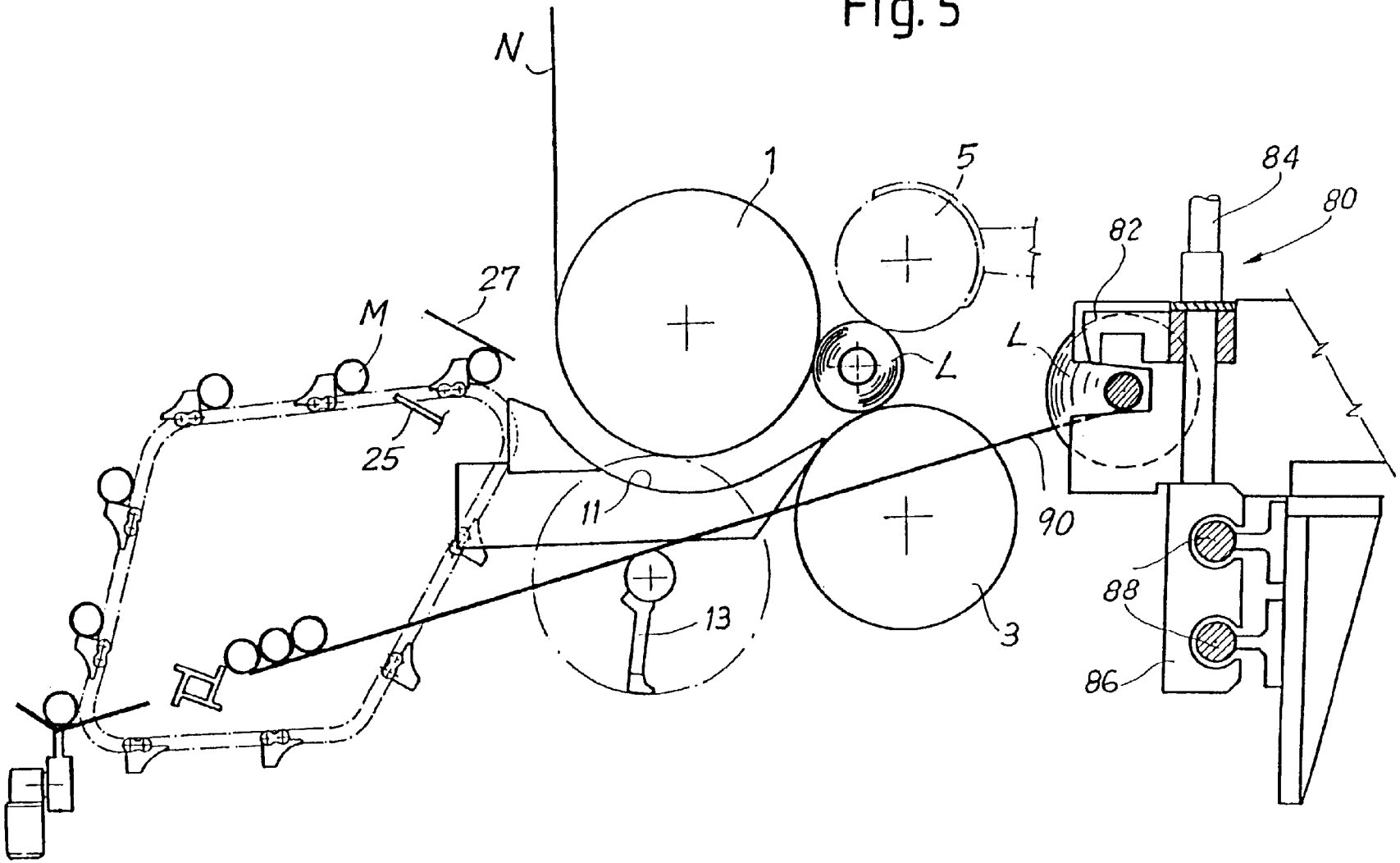
FIG. 5 shows a schematic side view of the rewinding machine with the spindle extraction means.

The completed log or roll L is unloaded from the winding cradle 1, 3 and 5 towards a station denoted generally by 80 in FIG. 5, where the winding spindle on which it has been formed is extracted so as to be recycled subsequently towards the insertion device 17. The system for extracting the spindle from the roll or log has, shown in schematic form, a jaw 82, opening and closing of which is performed by a cylinder/piston actuator 84. The jaw 82 is mounted on a sliding block 86 sliding on guides 88.

Where the winding spindle consists of one piece, a single jaw 82 is provided for gripping the end of the winding spindle projecting from the log L. The projecting end has an annular relief MR (visible in FIG. 4) for allowing engagement with the jaw 82. If the spindle is made as two halves, each of them has an annual relief projecting from the log L, and a pair of jaws 82 will be provided on the two sides of the machine in order to extract the two portions of the spindle from the two ends of the log.

Basically the mechanism for extracting the spindle from the log L may be provided as described in Italian Patent No. 1201390. FIG. 5 also shows schematically a recycling path 90 which conveys the spindles extracted from the completed logs towards a zone for removal by the insertion device 17. In this way, the logs produced by the machine will have an axial hole without a central winding core.

Figure 6:
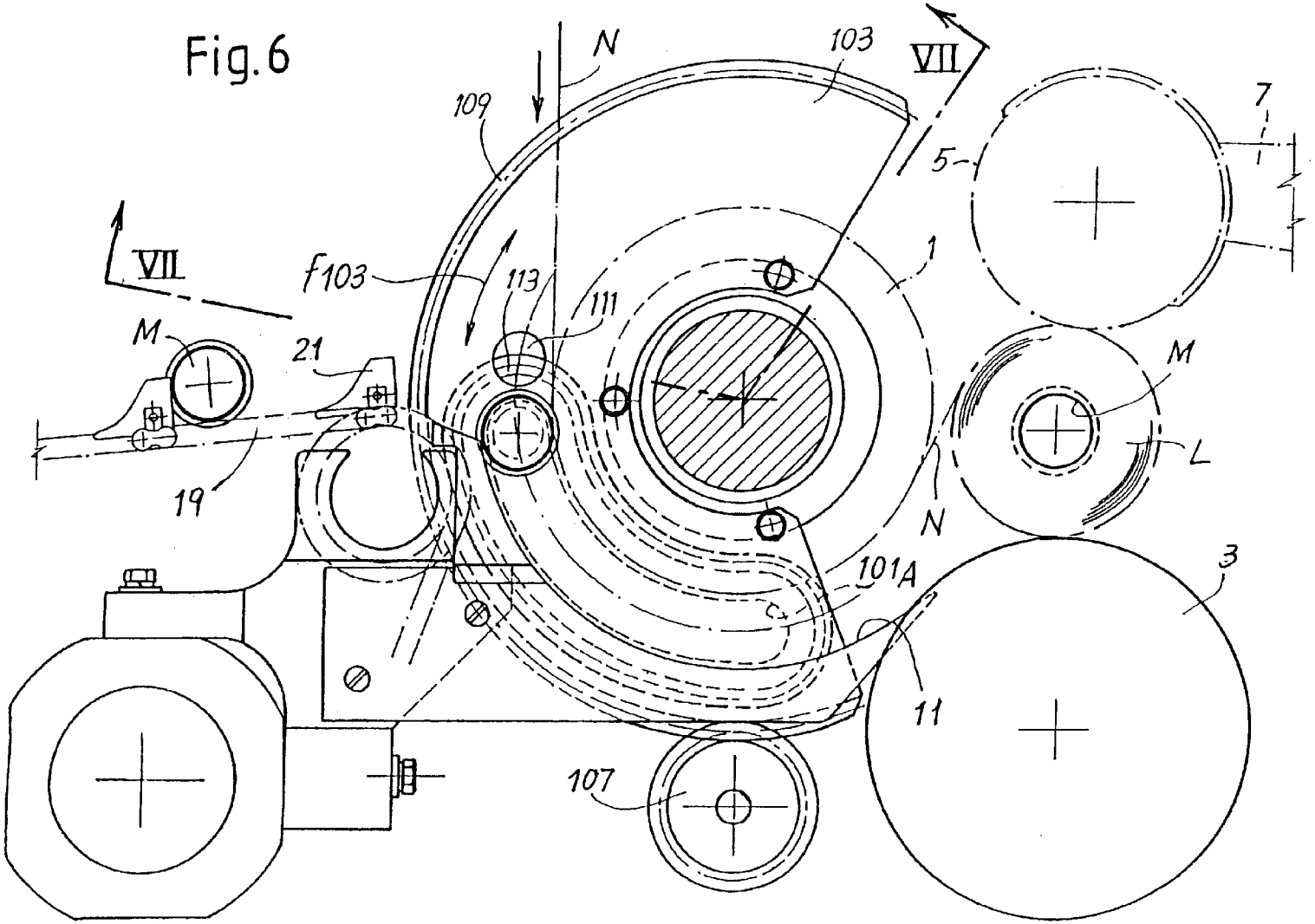
FIG. 6 shows a view, similar to that of FIG. 1, of a second embodiment.
Figure 7:
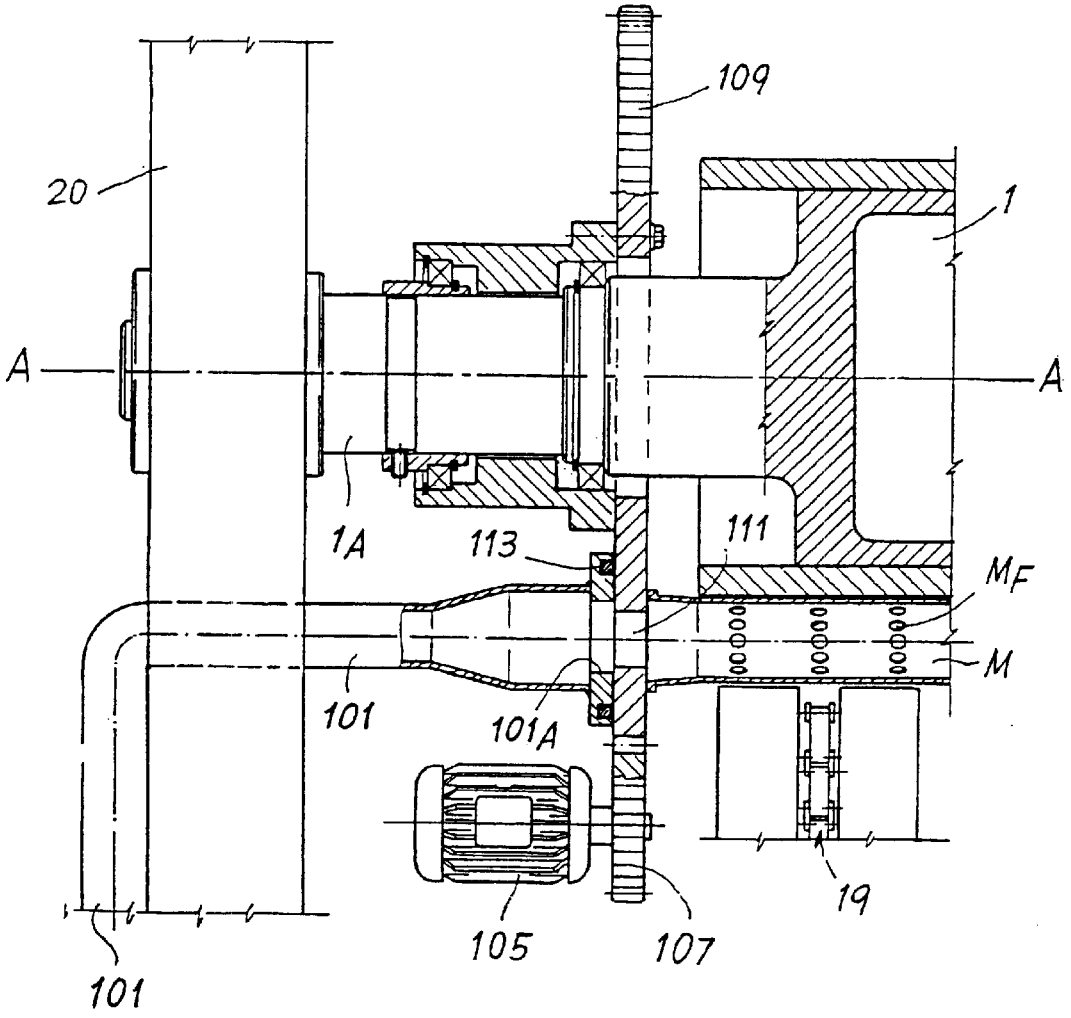
FIG. 7 shows a view along the line VII—VII according to FIG. 6.

FIGS. 6 and 7 show two partial cross-sectional views, similar to FIGS. 1 and 4, of a different embodiment. The same or corresponding parts are indicated by the same numbers. In this embodiment, the suction nozzle basically consists of a fixed suction duct 101 which has a mouth 101A shaped along a circumferential arc extending over slightly less than 90°, as can be seen in particular in FIG. 6. The mouth 101A follows the spindle insertion path.

The mouth 101A is closed by a wall 103 in the form of a circle segment having a length about twice the length of the mouth 101A. The wall 103 is movable angularly about the axis A—A of the winding roller 1. The movement is provided (in the example shown in the drawing) by a motor 105 which causes rotation of a pinion 107 meshing with a crown gear segment 109 integral with the wall 103. Alternatively, it is possible to envisage a moving system similar to that described in the preceding example of embodiment for moving the suction nozzle 51.

A circular opening 111 is provided in an intermediate position of the wall 103. A seal 113 is arranged between wall 103 and the mouth 101A of the fixed suction duct 101 (FIG. 7).

When the opening 111 is located outside of the mouth 101A of the suction duct 101 (as in the condition shown in FIG. 6), said mouth is closed by the wall 103. When a new spindle M must be inserted into the insertion path, the opening 111 is aligned with it, starting to move—as a result of rotation of the wall 103 in the direction of the arrow f103 about the axis A—A of the winding roller 1—so as to follow the movement of the spindle M. A vacuum is therefore produced inside the latter owing to the connection, via the opening 111, to the fixed suction duct 101. When winding of the first turn of web material around the spindle has been completed, suction may be interrupted and therefore the wall 103 with the opening 111 returns into the initial position.

Essentially, the fixed suction duct 101 and the movable opening 111 form a suction nozzle which follows the spindle along the insertion path.

In this case also it is possible to envisage two symmetrical arrangements on the two sides of the machine so as to produce a balanced vacuum inside the spindle M.

It is understood that the drawing shows only one practical embodiment of the invention, the forms and arrangements of which may vary, without, however, departing from the underlying idea of the invention. The presence of any reference numbers in the claims which follow merely has the aim of facilitating interpretation thereof with reference to the preceding description and the accompanying drawings, but does not limit the protective scope thereof.

What is claimed is:

1. A surface rewinding machine for the production of rolls of wound web material, comprising a winding cradle for winding web material and sequentially forming rolls of wound web material; an insertion device for sequentially inserting, into said winding cradle, winding spindles having a wall permeable to air on which said rolls are formed; an insertion path for introducing said spindles into said winding cradle; and a movable suction system which is controlled such as to follow said spindles along at least one portion of said insertion path so as to produce a vacuum inside said spindles.

2. Machine as claimed in claim 1, wherein said movable suction system is controlled such as to return to an initial position after insertion of a spindle, while a roll is still being formed on said spindle.

3. Machine as claimed in claim 1 or 2, wherein said suction system comprises at least one suction nozzle movable along said insertion path along which said at least one suction nozzle is pneumatically connected to the inside of the spindle which is inserted into said winding cradle.

4. Machine as claimed in claim 3, wherein two of said at least one suction nozzle are along said insertion path pneumatically connected to two opposite ends of said spindle.

5. Machine as claimed in claim 3, wherein said insertion path extends along a circumferential arc.

6. Machine as claimed in claim 5, wherein said winding cradle comprises at least one first winding roller which rotates about its axis and around which said web material is fed and wherein said insertion path has a center on the axis of said first winding roller.

7. Machine as claimed in claim 6, further comprising a rolling surface defining, together with said first winding roller, said insertion path for said spindles.

8. Machine as claimed in claim 6, wherein said winding cradle comprises a second winding roller defining, together with said first winding roller, a nip through which said spindles pass during winding.

9. Machine as claimed in claim 6, wherein said at least one suction nozzle is mounted on a rotating unit rotating about the axis of said first winding roller, and further comprising a movement device for controlling movement of said rotating unit about said axis in synchronism with movement of said insertion device.

10. Machine as claimed in claim 9, wherein said movement device causes a first rotary movement of said at least one suction nozzle in the direction of feeding of the spindles along said insertion path so as to follow each of said spindles from an insertion position to an intermediate position along said insertion path, followed by a movement in an opposite direction so as to bring back said at least one suction nozzle from the intermediate position into the insertion position.

11. Machine as claimed in claim 9, wherein said movement device comprises a motor and a gear wheel transmission.

12. Machine as claimed in claim 9, wherein said movement device comprises a wheel mounted idle on a shaft perpendicular to the axis of rotation of said first winding roller and supported by said rotating unit, and means which oblige said wheel to roll on a surface not rotating with respect to the axis of rotation of said first winding roller and on an annular surface of said first winding roller, perpendicular to its axis of rotation.

13. Machine as claimed in claim 12, wherein said means which oblige said wheel to perform a rolling movement comprises a pressing element movable in a direction parallel to the axis of rotation of said first winding roller.

14. Machine as claimed in claim 13, wherein said pressing element defines said non-rotating surface.

15. Machine as claimed in claim 14, wherein said pressing element extends over a portion of a circumferential extension of said first winding roller.

16. Machine as claimed in claim 12, wherein said rotating unit is associated with resilient recall members.

17. Machine as claimed in claim 3, wherein said at least one suction nozzle is movable along said insertion path with an alternating movement between an initial position and an end position.

18. Machine as claimed in claim 3, wherein said at least one suction nozzle is formed by a fixed suction duct and by a movable obturator arranged between the fixed suction duct and the spindles, the obturator following said spindles along said at least one portion of the insertion path.

19. Machine as claimed in claim 18, wherein said fixed suction duct has a curved shape.

20. Machine as claimed in claim 18, wherein said obturator consists of a movable wall adjacent to said fixed suction duct and has an opening with dimensions smaller that said fixed suction duct.

21. Machine as claimed in claim 1, further comprising downstream of said winding cradle, an extractor for extracting the winding spindles from each roll formed in said winding cradle; and a recycling path for conveying said spindles back towards said insertion device.

22. A method for producing rolls of wound web material, without a winding core, comprising the steps of: winding with a surface winding action a portion of web material of predetermined length around a winding spindle for forming a roll; and extracting said winding spindle from said roll, characterized by: providing suction holes on said spindle; providing at least one suction means cooperating with said spindle so as to produce a vacuum inside said spindle; maintaining said vacuum in said spindle while said spindle is displaced along an insertion path towards a winding cradle, moving said suction means along said insertion path; and causing a leading portion of said web material to adhere to said spindle by means of said vacuum inside said spindle.

23. Method according to claim 22, further including the step of returning said suction means into an initial position after adhesion of said web material to said spindle while continuing winding of said web material around said spindle.

24. Method as claimed in claim 22 or 23, further comprising causing said spindle to roll along said path.

25. Method as claimed in claim 22 or 23 further comprising producing said vacuum in said spindle by axially arranging a suction nozzle next to at least one end of said spindle.

26. Method as claimed in claim 25, further comprising arranging a suction nozzle next to each end of said spindle.

27. Method as claimed in claim 22, further comprising causing said at least one suction means to advance along said path in the direction of insertion of said spindle.

28. Method as claimed in claim 27, further comprising moving said at least one suction means along said path with an alternating movement.

29. Method as claimed in claim 22, wherein said insertion path extends substantially in the manner of an arc of a circle.

30. Method as claimed in claim 29, wherein said insertion path has a center lying on the axis of a first winding roller, around which said web material is conveyed.

31. Method as claimed in claim 30, wherein said spindle is made to roll along said insertion path between said first winding roller and an approximately cylindrical rolling surface extending around said first winding roller.

32. Method as claimed in claim 22, wherein the vacuum inside said spindle is maintained until a turn of web material has been wound around the latter.

* * * * *